US006332631B1

(12) United States Patent
Kirk

(10) Patent No.: US 6,332,631 B1
(45) Date of Patent: Dec. 25, 2001

(54) PEEL BACK AND RE-SEALABLE EXTENDED TEXT LABEL WITH DETACHMENT SEGMENT

(75) Inventor: Dana S. Kirk, Kearns, UT (US)

(73) Assignee: Impaxx, Inc., Schaumburg, IL (US)

( * ) Notice: Subject to any disclaimer, the term of this patent is extended or adjusted under 35 U.S.C. 154(b) by 0 days.

(21) Appl. No.: 09/684,051

(22) Filed: Oct. 6, 2000

Related U.S. Application Data

(60) Provisional application No. 60/177,808, filed on Jan. 25, 2000.

(51) Int. Cl.[7] ..... B42D 15/00

(52) U.S. Cl. ..... 283/81; 283/101; 283/105; 40/310

(58) Field of Search ..... 283/79, 80, 81, 283/101, 103, 105, 900; 40/299, 310, 360, 630; 428/43

(56) References Cited

U.S. PATENT DOCUMENTS

| | | | | |
|---|---|---|---|---|
| D. 311,423 | | 10/1990 | DeSantis . | |
| 4,246,709 | | 1/1981 | Selleslags . | |
| 4,312,523 | | 1/1982 | Haines . | |
| 4,332,971 | | 5/1987 | Adams . | |
| 4,544,590 | | 10/1985 | Egan . | |
| 4,585,254 | | 4/1986 | Adams . | |
| 4,700,976 | * | 10/1987 | Loose | 283/81 X |
| 4,727,667 | | 3/1988 | Ingle . | |
| 4,763,930 | * | 8/1988 | Matney | 283/81 |
| 5,019,436 | | 5/1991 | Schramer et al. . | |
| 5,056,827 | | 10/1991 | Sasso . | |
| 5,085,906 | | 2/1992 | Ast et al. . | |
| 5,264,265 | | 11/1993 | Kaufmann . | |
| 5,328,738 | | 7/1994 | McKillip et al. . | |
| 5,329,713 | | 7/1994 | Lundell . | |
| 5,342,093 | * | 8/1994 | Weenik | 283/81 |
| 5,704,648 | | 1/1998 | Brown et al. . | |
| 5,809,674 | | 9/1998 | Key . | |
| 5,853,836 | | 12/1998 | Zoss . | |
| 5,904,973 | | 5/1999 | Coward et al. . | |
| 5,924,739 | | 7/1999 | Garbutt . | |
| 5,958,536 | | 9/1999 | Gelsinger et al. . | |
| 6,116,654 | * | 9/2000 | Grootveld | 283/75 |

* cited by examiner

*Primary Examiner*—Willmon Fridie, Jr.
(74) *Attorney, Agent, or Firm*—Parsons Behle & Latimer

(57) ABSTRACT

A label for a container is disclosed as including a front side and a back side. The front side has front label information thereon for communicating information to a user. The back side includes a first end and a second end and has an adhesive thereon proximate the first end such that a part of the label is substantially permanently attached to the container. The back side also has a removably-attaching surface proximate the second end. Back side label information is on the back side for communicating information to the user. The removably-attaching surface enables the label to be removably attached to the container such that the user may view the back side label information by peeling back part of the label from the container to reveal the back side label information. Further, the user may return the label to wrap around the container such that the back side label information is not visible by pressing the other part against the container. Detachment segments are also provided between the removably and the substantially permanently adhered portions of the label to preclude inadvertent removal of the entire label.

14 Claims, 5 Drawing Sheets

PEEL BACK AND RE-SEALABLE EXTENDED TEXT LABEL WITH DETACHMENT SEGMENT

RELATED APPLICATIONS

This application claims priority to U.S. Provisional Application No. 60/177,808, filed on Jan. 25, 2000, and to U.S. patent application Ser. No. 09/539,156, filed on Mar. 30, 2000, which are incorporated herein by reference.

BACKGROUND

1. The Field of the Invention

The present invention relates generally to labels that are attached to containers, and more specifically to labels with portions that may be peeled back and then re-sealed for viewing textual and/or graphic materials on the back of the label.

2. The Background Art

In the marketing and selling of certain products, such as medicines, nutritional supplements, foods, etc., it is necessary that the container for a particular product be properly labeled. Labels may include a wide range of information including the name of the product, its ingredients, the product's batch or lot number, the expiration date for use of the product and necessary instructions relating to the dispensing and use of the product.

Unfortunately, the amount of information that can be located on a conventional label of a type which is entirely adhered to the surface of a container, such as a bottle, is limited by the surface area of the container. Because of this limited information space on the label, it was not possible to print as much information as desired on one label. As a result, either the label did not have all the information that the manufacturer or distributor desired to be on the label, or other means were used to include the additional information.

To increase the amount of information that can be located on a label attached to a container, alternative labels have been employed. For example, one such label shows an elongated strip label that is folded to form a stack of sheets. The bottom sheet of the stack is adhered to the container. The top sheet of the stack is secured to an adjacent sheet to maintain the label in a closed condition. With fold-out labels, the label must be generally folded before it is adhered to the container. As a result, intermediate folded layers cannot be inspected to insure against improper labeling after the label is attached. Moreover, fold-out labels require multiple manufacturing steps which adds both time and cost to the labeling process.

Another alternative for increasing the amount of information that can be located on a label adhered to a container is the use of a wrap around label which overlaps itself. The overlapping portion of these labels must have sufficient adherence to adhere to the underlying contact portion of the label that is adjacent the container. At the same time, however, the adherence of the overlap portion must be limited so as to allow the overlap portion to be peeled away from the underlying contact portion of the label. One label obtains this desired adherence by over-coating the surface of the underlying layer with a coating to which the adhesive can not form a permanent bond. However, this type of label can be difficult to apply and is more costly due to two layers of material.

Many consumer products are sold in bottles, cans, or jars. Some of these products require detailed instructions for use, product safety warnings, or nutritional information. Frequently the container is not large enough to support a label that can carry enough information to satisfy these needs. The alternatives to fill these needs are generally more expensive, difficult to apply, and some have folded leaflets that are easily removed and lost.

BRIEF SUMMARY AND OBJECTS OF THE INVENTION

In view of the foregoing, it is an object of the present invention to provide a label that can be applied by standard label applications equipment, is simple to use and consumer friendly, can stand up to multiple openings and re-closures, and is less costly than the other options. This invention also allows the package designer to maintain the same package design, by only adding text onto the back of the label.

Consistent with the foregoing object, and in accordance with the embodiments as embodied and broadly described herein, a label for a container is disclosed as including a front side and a back side. The front side has front label information thereon for communicating information to a user. The back side includes a first end and a second end and has an adhesive thereon proximate the first end such that a part of the label is substantially permanently attached to the container. The back side also has a removably-attaching surface proximate the second end. Back side label information is on the back side for communicating information to the user. The removably-attaching surface enables the label to be removably attached to the container. The user may view the back side label information by peeling back the removably attached part of the label from the container to reveal the back side label information. Further, the user may return the label to wrap around the container such that the back side label information is not visible by pressing the removably attached part against the container.

A label made in accordance with the disclosed embodiments may optionally include a peel tab. In addition, in an embodiment of the label substantially all of the back side may have the adhesive thereon and a barrier coating may be applied to a portion of the back side to cover the adhesive on the portion and to neutralize the adhesive on the portion. The barrier coating may cause the label to have an affinity to lightly adhere to the container. In one embodiment, the barrier coating may be a latex-based overprint varnish.

In addition, the label includes at least one detachment segment that prevents inadvertent removal of the entire label upon peeling back the removably attached part of the label from the container to reveal the back side label information.

A method practiced in accordance with the disclosed embodiments may include the steps of obtaining label stock wherein the label stock has a front side and a back side, and wherein the back side includes an adhesive, printing back information on an area on the back side of the label stock, applying a barrier coating to the print area on the back side of the label stock, and printing front information on the front side of the label. The method may also include using label stock obtained in a liner and including the step of de-laminating the liner to uncover the label stock. Another step that may be included is cutting the label stock to a proper shape for the container. Still another step includes providing at least one detachment segment in the label that prevents inadvertent removal of the entire label.

BRIEF DESCRIPTION OF THE DRAWINGS

The foregoing and other objects and features of the present embodiments will become more fully apparent from the following description and appended claims, taken in conjunction with the accompanying drawings. Understanding that these drawings depict only typical embodiments and are, therefore, not to be considered limiting of the invention's scope, the embodiments will be described with additional specificity and detail through use of the accompanying drawings in which:

DETAILED DESCRIPTION

It will be readily understood that the components of the embodiments, as generally illustrated in the Figures and described herein, could be arranged and designed in a wide variety of different configurations. Thus, the following more detailed description of the embodiments of the systems and methods disclosed, as represented in FIGS. 1 through 15, is not intended to limit the scope of the invention, as claimed, but is merely representative of the presently preferred embodiments.

The presently preferred embodiments will be best understood by reference to the Figures, wherein like parts are designated by like numerals throughout.

Figure 1:
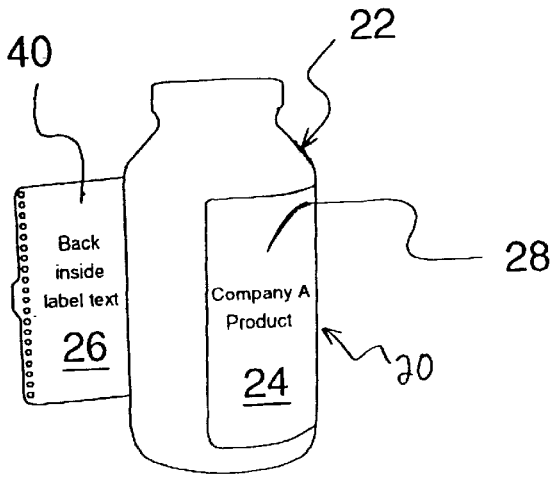
FIG. 1 is perspective view of a container with an embodiment attached thereto and illustrating the usefulness of the embodiment.

Generally, as shown in FIG. 1, a label 20 for a container 22 is described as including a front side 24 and a back side 26. The front side 24 includes front label information 28 thereon for communicating information to a user. As shown, a portion of the label 20 may be peeled back to reveal back side label information 40.

Figure 2:
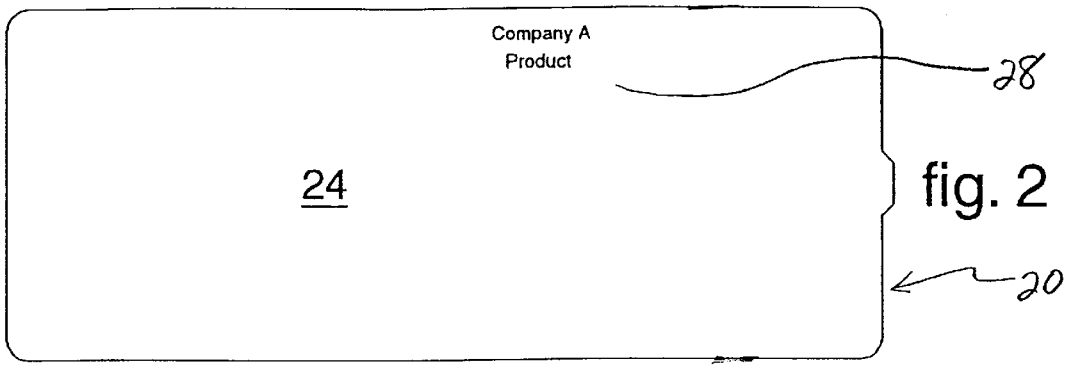
FIG. 2 is a front elevational view of an embodiment.

FIG. 2 is a front elevational view of an embodiment described herein. The front side 24 is illustrated in FIG. 2 where the label 20 is shown not attached to a container 22. As shown, the appearance of the front side 24 of the label 20 may be similar to conventional labels which enables labels using the present embodiments to maintain any standard designs for the labels that have been used in the past without the need for redesigning the labels.

Figure 3:
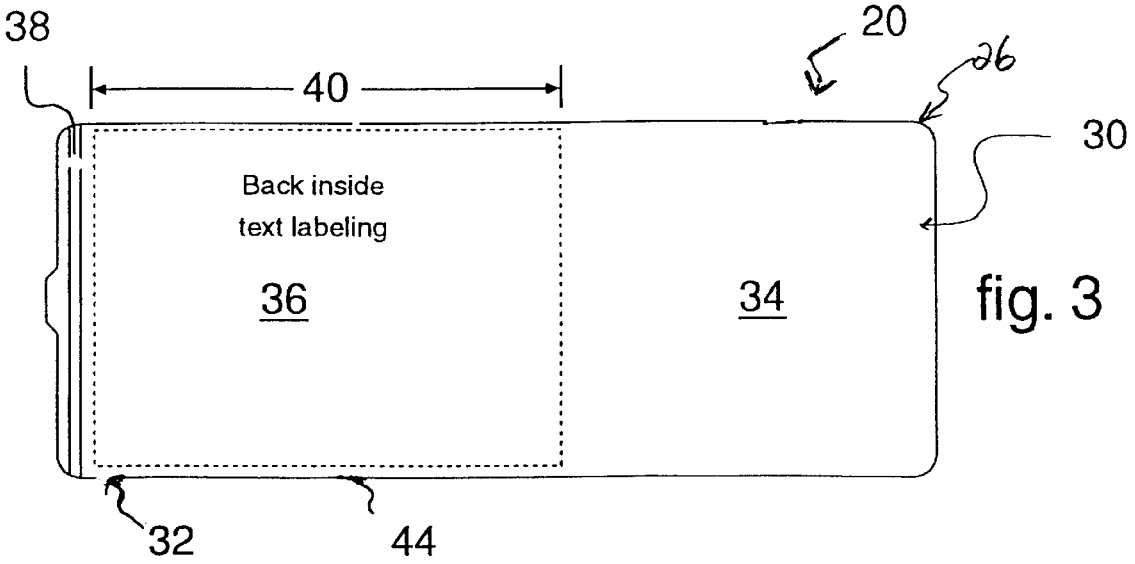
FIG. 3 is a rear elevational view of an embodiment.

Referring now to FIG. 3, the back side 26 includes a first end 30 and a second end 32. The back side 26 also includes a first portion 34 proximate the first end 30, a second portion 36, and a third portion 38 proximate the second end 32. The first portion 34 has an adhesive thereon such that the first portion 34 may be substantially permanently attached to the container 22. "Substantially permanently" as it is used herein means that removal of the first portion is difficult, but not impossible. Removal of the substantially permanently attached first portion could be accomplished by scraping the label off the container, applying chemical compositions to break down the substantially permanent attachment, and, but not limited to, applying excessive force when peeling back the second portion from the container.

The second portion 36 has a non-attaching surface. The second portion 36 also has back side label information 40 thereon for communicating information to the user. The third portion 38 has a first adhesive thereon such that the third portion 38 may be removably attached to the container 22.

As illustrated in FIG. 3, the first portion 34 and the third portion 38 are disposed on the back side 26 such that the second portion 36 is positioned between the first 34 and third portions 38.

Figure 4:
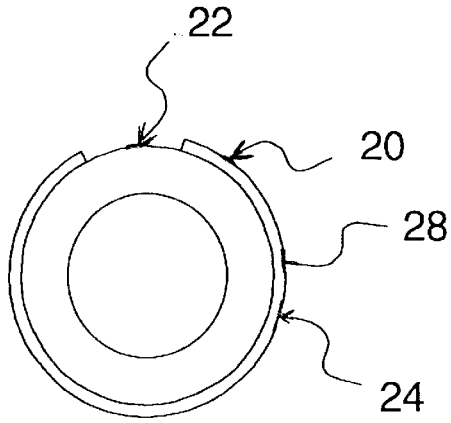
FIG. 4 is a top plan view of a container with an embodiment attached thereto.
Figure 5:
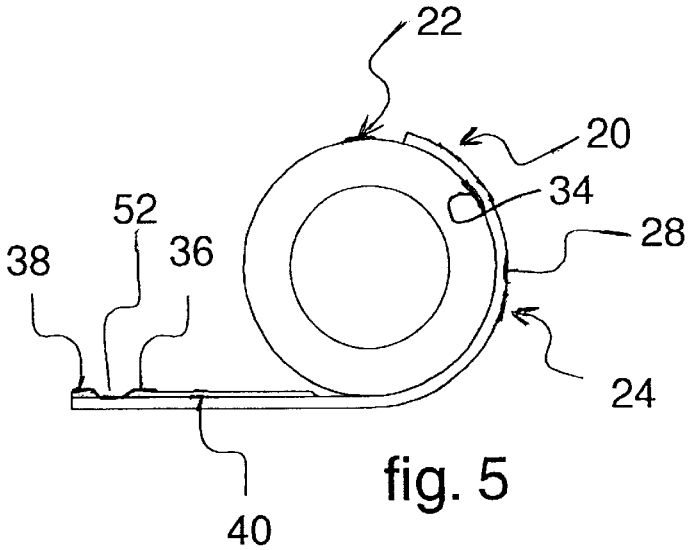
FIG. 5 is a top plan view of the container and label shown in FIG. 1 illustrating the label in a peeled-back position.

FIG. 4 illustrates a top plan view of the container 22 with the label 20 attached thereto. In its state as shown in FIG. 4, a user may only view the front label information 28. The user or consumer may view the back side label information 40 by peeling back the third portion 38 and the second portion 36 from the container 22 to reveal the back side label information 40 as illustrated in FIG. 5. The user may return the label 20 to wrap around the container 22 as shown in FIG. 4 such that the back side label information 40 is not visible by pressing the third portion 38 against the container 22.

Those skilled in the art will appreciate that various methods may be employed to produce labels 20. In the presently preferred embodiments, blank label stock is ordered from a label stock manufacturer. For example, the Avery Dennison company supplies such label stock. Typically, when these label stocks arrive, they have no graphics printed on them. In addition, the front side 28 is entirely free of any adhesive, while the back side 26 is entirely covered with adhesive.

When label stocks are obtained in this "raw" and original state, the second portion 36 of the label stock has adhesive thereon. To neutralize the adhesive a barrier coating 44, illustrated in FIG. 3, is applied to the second portion 36. The barrier coating 44 substantially covers the second portion 36. The barrier coating 44 acts as a detackifying or deadening agent to the adhesive. Once applied, the barrier coating 44 makes it so the second portion 36 has no tacky adhesive, allowing it to remove cleanly from the container. The barrier coating 44 also has an affinity to lightly adhere to the container 22 such that after the label 20, specifically the second and third portions 36, 38, is peeled back by the consumer, it tends to spring back and lay flat on the container 22 if the consumer neglects to actively re-seal the label 20 to the container 22.

The barrier coating 44 is designed such that resealability during multiple openings and re-closures is achieved without a tacky adhesive, minimizing adhesive contamination and graphic degradation due to contaminants from consumers' handling of the product.

In a preferred embodiment, barrier coating 44 is transparent and comprises a water-based product. In a more preferred embodiment, barrier coating 44 comprises a varnish. Most preferably, barrier coating 44 comprises Crystal Coat Barrier CAOP-3631 overprint varnish available from Akzo Nobel, Inc.

Barrier coating 44 is preferably printed on the second portion 36 of the label 20. However, any suitable application method, such as spot vanishing, may be used to apply coating 44 to the second portion 36 of the label 20. The barrier coating 44 prevents the adhesive that was originally on the raw label as it was obtained by a label manufacturer from permanently adhering second portion 36 to the container, thus, permitting second portion 36 to be peeled away from the container 20 to expose the printed material on the second portion 36. In addition, second portion 36 may be re-adhered to the container 22. The barrier coating also causes the second portion to have an affinity for the container such that the second portion can return to its original position around the container via memory.

The adhesive coating on the first portion 34 has sufficient adherence to permanently attach first portion 34 to the container 22. Suitable adhesives include Fasson S-1000, Fasson S900, S-2001 and similar adhesives.

A method may be practiced to prepare embodiments herein from raw label stock obtained from a label stock manufacturer. The equipment used to practice this method is commercially available. First, the liner may be de-laminated such that the liner may be pulled away from the label stock. Then textual or graphical information may be printed on the adhesive that is on the back side 26 of the label 20. This textual or graphical information so printed is the back side label information 40. Then a barrier coating may be applied over the second portion 26 such that the section portion 26 may be peeled back from the container 22. The barrier coating 44 may be a latex based varnish, such as, for example, the Crystal Coat barrier available from Akzo Nobel, Inc. described above. This latex has an affinity for the container 22 and acts to kill the adhesive. It will be appreciated that any barrier coating may be used that deadens the adhesive in such a way that the adhesive cannot migrate through the barrier coating and has an affinity for the container.

Once the barrier coating has been applied, the label is placed back in contact with the liner. Then, the front label information 28 is printed on the front side 24 of the label 20. After the front label information 28 has been printed, the label may be cut to its proper shape for the particular container 22. The waste may be removed and discarded. It will be appreciated by those skilled in the art that the aforementioned steps could be performed in a different order to achieve the embodiments and described herein.

Figure 6:
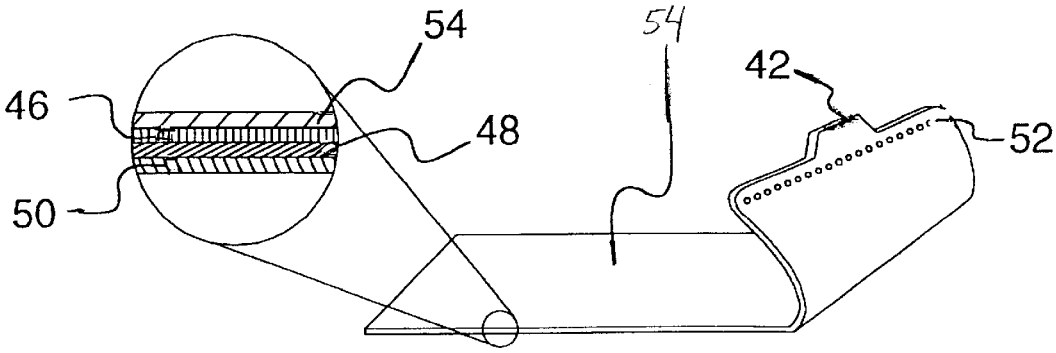
FIG. 6 is a perspective view of an embodiment with a close-up cross-sectional view of a portion of the embodiment.

Referring now to the FIG. 6, an embodiment of a label 20 is described with more specificity wherein the label 20 is comprised of a base material 46 that may be made from paper, plastic, or other suitable label stock, as will be a matter of choice for one skilled in the art. The underside of the base material 46 is coated with a permanent pressure sensitive adhesive 48. The back side label information 40 is printed over the permanent adhesive 48 using an ink that will not rewet when in contact with the barrier coating. Covering the back side label information 40 and a portion of the permanent adhesive 48 is a latex-based barrier coating 50, which performs as a deadening agent to the permanent adhesive 48. It also has an affinity to lightly adhere to non-porous surfaces as that of the container 22 to which it is affixed.

Figure 7:
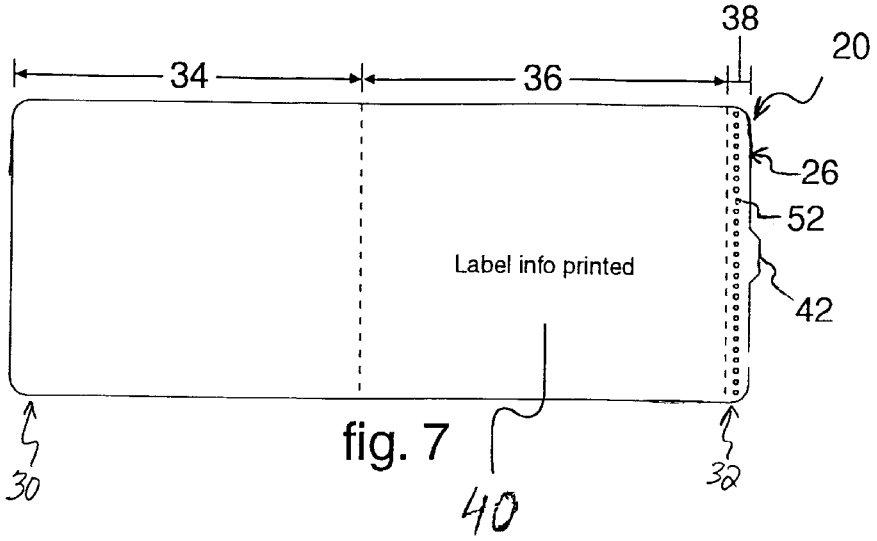
FIG. 7 is a top plan view of an embodiment illustrating voids.

As illustrated in FIG. 6, on the peelable end of the label, there may be a peel tab 42 that facilitates opening and viewing the second and third portions 36, 38 of the label 20. In an embodiment as shown in FIGS. 6 and 7, next to the peel tab 42 exists a line of voids 52 in the a latex-based barrier coating 50. The voids 52 are mainly for label application use. When automatically applying these labels 20, these spots 52 of permanent adhesive prevent the label from peeling up in the label applicator and/or while packaging.

There is a dwell time needed for the label material to develop a memory for the shape of the container. Those skilled in the art will appreciate the benefit of having a label material that develops a memory.

To provide added durability for multiple peel backs, a polypropylene laminate 54 is adhered to the top of the base material 46 after the graphics are printed on it. For a paper label it provides tear protection, and for plastics or films, it prevents stretching.

When adhered to the container 22, one only needs to pull up on the peel tab 42 away from the container. The label 20 will lift freely away from the container 22, with only a light adhesion to the container 22, until it reaches the portion of the label 20 that is permanently affixed to the container 22. This will reveal the back side label information 40 while also keeping in view the front side showing text or graphics across its entirety. After reviewing the back side label information 40, the lifted portion 36, 38 needs only to be lightly wrapped back around the container 22.

In current design, embodiments utilize a peel tab 42 that is centered on the second side 32 of the label 20, and extended from the normal label shape and shown in FIG. 6. Other variations may include a peel tab 42 situated on the corner of the label 20, or any another protruding portion away from the main body of the label 20.

The apparent voids 52 in the a latex-based barrier coating 50 may change in shape or patterns, according to what may work best with the shape of the labels, as a matter of choice for one skilled in the process.

Figure 8A:
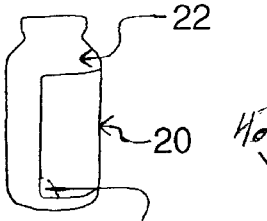
FIGS. 8A and 8B illustrate an embodiment with a peel tab positioned on a corner of the embodiment.
Figure 8B:
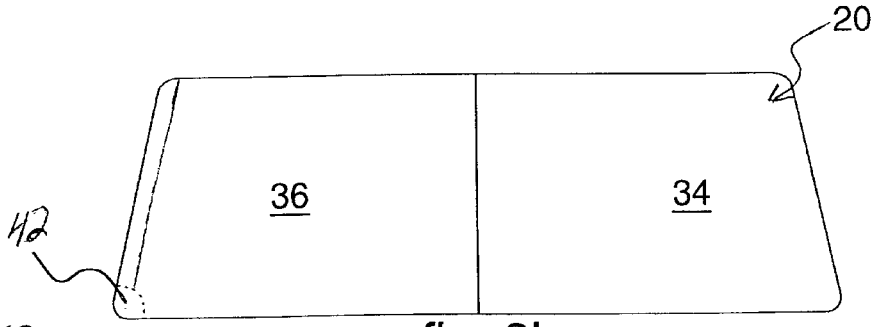

In embodiments herein, the first portion 34 of the label 20 may be permanently adhered via permanent adhesive along the first edge 30 to the container 22. Additionally, and as shown in FIGS. 8A and 8B, third portion 38 may include an area that functions as a consumer peel-tab 42. In embodiments herein, there may be no tacky adhesive on the second portion 36. Accordingly, to view the back side label information 40 in FIGS. 8A and 8B, a consumer may pull on the peel-tab 42 to reveal the back side label information 40. The peel-tab 42 provides a consumer-friendly mechanism for peeling back and resealing the label.

Figure 9A:
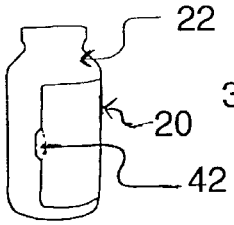
FIGS. 9A and 9B illusrate an embodiment with a peel tab positioned in a centered position.
Figure 9B:
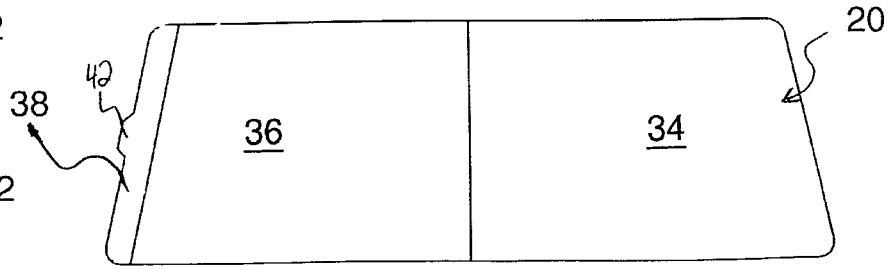
Figure 10A:
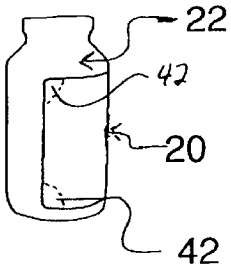
FIGS. 10A and 10B illustrate an embodiment with multiple peel tabs positioned on opposing comers of the embodiment.
Figure 10B:
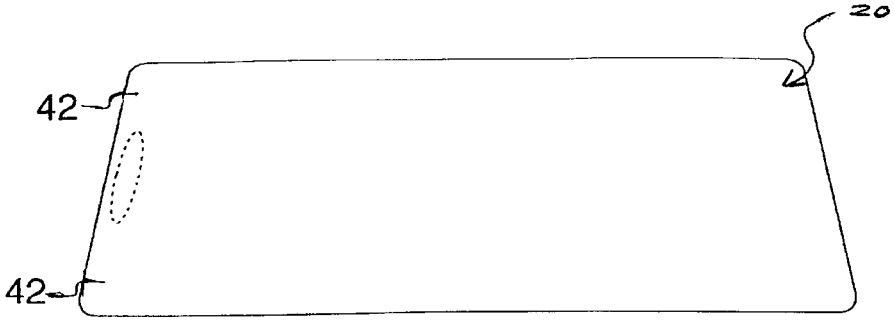
Figure 11A:
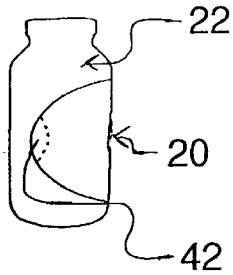
FIGS. 11A and 11B illustrate an embodiment of an oval shape with a peel tab positioned in a centered position.
Figure 11B:
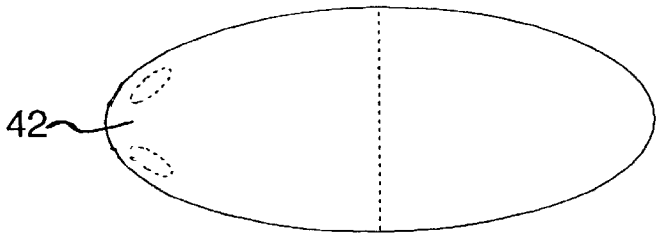
Figure 12A:
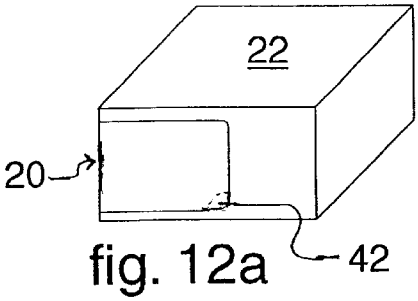
FIGS. 12A and 12B illustrate an embodiment used with a rectangular-shaped container with a peel tab positioned on a comer of the embodiment.
Figure 12B:
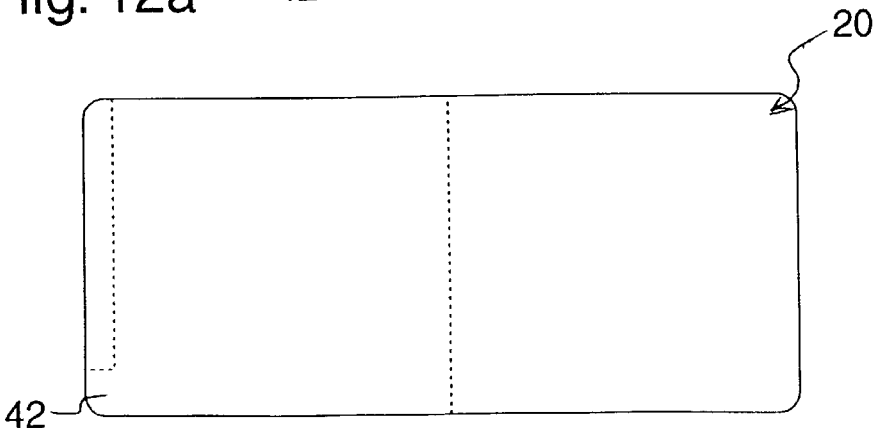
Figure 13:
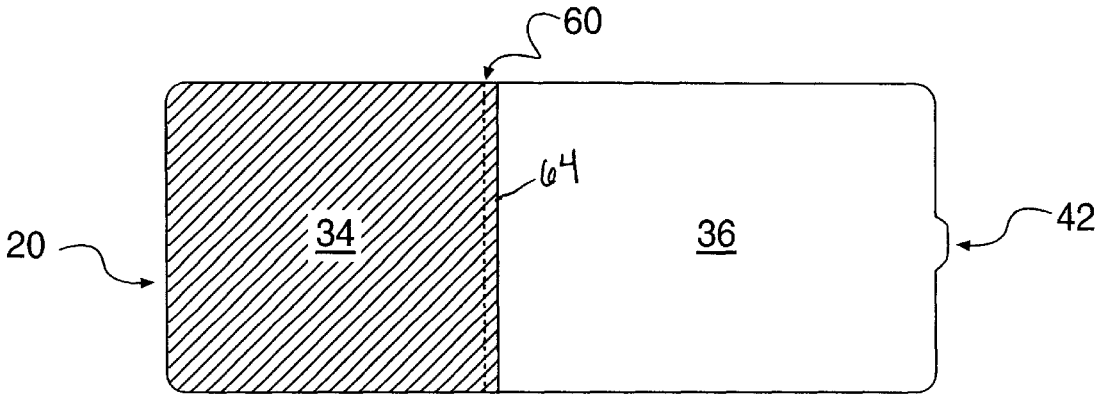
FIG. 13 illustrates a rear elevational view of an embodiment including detachment segments.

FIGS. 9A and 9B illustrate a peel tab 42 centered along the second side 32. FIGS. 10A and 10B illustrate multiple peel tabs 42 on each comer of the third portion 38. FIGS. 11A and 11B illustrate a label of an oval shape having a peel tab 42 centered as shown. FIGS. 12A and 12B show a label 20 as disclosed herein being applied to a substantially rectangular shaped container 22.

Figure 14:
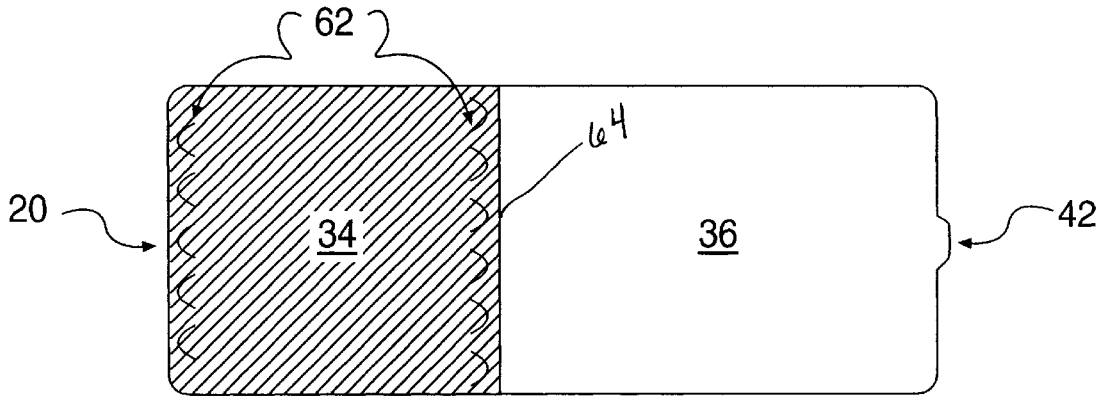
FIG. 14 is a rear elevational view of another embodiment including detachment segments.

In a further embodiment depicted in FIG. 14, the label 20 includes detachment segments 62 along the interface 64 between the substantially permanently adhered first portion 34 and the removably adhered second portion 36. The detachment segments prevent a user from inadvertently removing the substantially permanently adhered first portion by forcibly peeling the label past the transition between the removably adhered second portion and the substantially permanently adhered first portion. Rather, the detachment segments will cause the second portion to tear and detach before the entire label can be removed. Information that is critical to the product contained in the container can thereby be provided on the substantially permanently adhered portion of the label without concern that an over aggressive user will inadvertently remove it while peeling back the removably adhered second portion.

Figure 15:
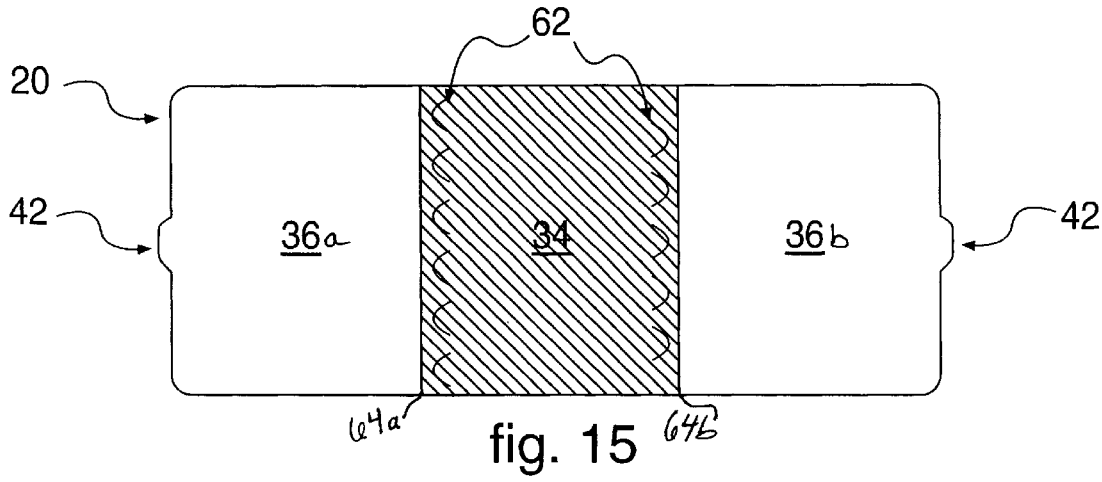
FIG. 15 illustrates a rear elevational view of yet another embodiment including detachment segments.

In an alternate embodiment illustrated in FIG. 15, the permanently adhered first portion 34 may be sandwiched between two removably adhered second portions 36*a,* 36*b*. The interfaces 64*a,* 64*b* between second portions 36*a,* 36*b* and first portion 34 include detachment segments along the length of the interfaces.

Detachment segments preferably comprise a plurality of spaced apart cuts such as the half moon shaped cuts depicted in FIGS. 14 and 15. In an alternate embodiment illustrated in FIG. 13, the detachment segments comprises perforations 60 along the label 20 at or about the interface 64 between the first 34 and second 36 portions.

As will be appreciated by those skilled in the art, there are a variety of means to implement the present embodiments to various configurations of containers and/or labels. Further, it is understood that the examples described above are not meant to limit the scope of the present invention.

From the above discussion, it will be appreciated that the present embodiments disclosed provide labels that when applied to a container, provide a portion that may be peeled back to reveal extended text information, then easily re-sealed to the container after reviewing the extended text, and which preclude inadvertent removal of the entire label.

The present invention may be embodied in other specific forms without departing from its spirit or essential characteristics. The described embodiments are to be considered in all respects only as illustrative, and not restrictive. The scope of the invention is, therefore, indicated by the appended claims, rather than by the foregoing description. All changes which come within the meaning and range of equivalency of the claims are to be embraced within their scope.

What is claimed is:

1. A label for a container, the label comprising a front side having front label information thereon for communicating information to a user; and a back side comprising:

a) a first portion, the first portion having an adhesive thereon such that the first portion is substantially permanently attached to a container; and b) at least one second portion, the second portion having i) a removably-attaching surface that enables the second portion to be removably-attached to the container;

ii) back side label information thereon for communicating information to the user, wherein the removably-attaching surface enables the user to view the back side label information by peeling back the removably-attached second portion from the container to reveal the back side label information, and enables the user to reattach the second portion to the container by pressing down on the front side of the label proximate the second portion; and wherein the first and second portions are separated via at least one detachment segment in the label, the detachment segment causing the second portion to detach from the first portion if the user attempts to remove the entire label.

2. The label of claim 1, further comprising a peel tab.

3. The label of claim 1, wherein the second portion of the backside of the label has an adhesive thereon.

4. The label of claim 3, wherein a barrier coating has been applied to the second portion to cover and to neutralize the adhesive.

5. The label of claim 4, wherein the barrier coating causes the label to have an affinity to removably adhere to the container, and to return via memory around the container.

6. The label of claim 4, wherein the barrier coating comprises a latex-based overprint varnish.

7. The label of claim 1, wherein the second portion includes a plurality of voids.

8. A label for a container, the label comprising a front side having front label information thereon for communicating information to a user; and a back side comprising:

a) a first portion, the first portion having an adhesive thereon such that the first portion is substantially permanently attached to a container; and b) at least one second portion, the second portion having i) a removably-attaching surface that enables the second portion to be removably-attached to the container;

ii) back side label information thereon for communicating information to the user, and c) a third portion proximate the second portion, the third portion having a first adhesive thereon such that the third portion may be removably attached to the container, the first portion and the third portion being disposed on the back side such that the second portion is positioned between the first and third portion, wherein the user may view the back side label information by peeling back the third portion and the second portion from the container to reveal the back side label information and wherein the user may return the label to wrap around the container such that the back side label information is not visible by pressing the third portion against the container; and wherein the first and second portions are separated via at least one detachment segment in the label, the detachment segment causing the second portion to detach from the first portion if the user attempts to remove the entire label when peeling back the second portion.

9. The label of claim 8, further comprising a peel tab proximate the third portion.

10. The label of claim 9, wherein the second portion of the backside of the label has an adhesive thereon.

11. The label of claim 10, wherein a barrier coating has been applied to the second portion to cover and to neutralize the adhesive.

12. The label of claim 11, wherein the barrier coating causes the label to have an affinity to removably adhere to the container.

13. The label of claim 11, wherein the release coating comprises a latex-based overprint varnish.

14. The label of claim 11, wherein the third portion includes a plurality of voids in the barrier coating.

* * * * *